US012492090B2

(12) United States Patent
Phan

(10) Patent No.: US 12,492,090 B2
(45) Date of Patent: Dec. 9, 2025

(54) SHEET CONVEYING DEVICE AND IMAGE FORMING APPARATUS

(71) Applicant: KYOCERA Document Solutions Inc., Osaka (JP)

(72) Inventor: Doan Huu Phan, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/668,058

(22) Filed: May 17, 2024

(65) Prior Publication Data

US 2024/0383708 A1 Nov. 21, 2024

(30) Foreign Application Priority Data

May 19, 2023 (JP) ..... 2023-083124

(51) Int. Cl.
*B65H 1/04* (2006.01)
*B65H 9/08* (2006.01)

(52) U.S. Cl.
CPC ..... *B65H 9/08* (2013.01); *B65H 1/04* (2013.01); *B65H 2405/1117* (2013.01); *B65H 2405/1142* (2013.01); *B65H 2801/12* (2013.01)

(58) Field of Classification Search
CPC .... B65H 9/08; B65H 1/04; B65H 2405/1117; B65H 2405/1142; B65H 2801/12; B65H 2511/10
See application file for complete search history.

(56) References Cited

U.S. PATENT DOCUMENTS

2015/0344244 A1* 12/2015 Koga ..... B65H 1/00 271/147

FOREIGN PATENT DOCUMENTS

JP H09104547 A 4/1997
JP 11-106061 * 4/1999

* cited by examiner

*Primary Examiner* — Thomas A Morrison
(74) *Attorney, Agent, or Firm* — Alleman Hall & Tuttle LLP

(57) ABSTRACT

A main tray can be exposed from and stored in an image forming apparatus main body by being pivotably supported by the image forming apparatus main body, and when the main tray is exposed from the image forming apparatus main body, a sheet can be placed on the main tray and a sheet can be supplied from the main tray into the image forming apparatus main body. The main tray includes a sheet placing portion and a width alignment cursor. The width alignment cursor is disposed on the sheet placing portion to align the width of a sheet. The width alignment cursor moves in the width direction of the sheet in conjunction with the main tray being stored in the image forming apparatus main body.

3 Claims, 4 Drawing Sheets

SHEET CONVEYING DEVICE AND IMAGE FORMING APPARATUS

INCORPORATION BY REFERENCE

This application is based upon and claims the benefit of priority from the corresponding Japanese Patent Application No. 2023-083124 filed on May 19, 2023, the entire contents of which are incorporated herein by reference.

BACKGROUND

It is known that an image forming apparatus includes a main tray and a guide plate. The main tray is required to be able to be stored in the image forming apparatus.

SUMMARY

A sheet conveying device according to the present disclosure includes a main tray. The main tray can be exposed from and stored in an image forming apparatus main body by being pivotably supported by the image forming apparatus main body, and when the main tray is exposed from the image forming apparatus main body, a sheet can be placed on the main tray and the sheet can be supplied from the main tray into the image forming apparatus main body. The main tray includes a sheet placing portion and a width alignment cursor. The width alignment cursor is disposed on the sheet placing portion to align the width of the sheet. The width alignment cursor moves in the width direction of the sheet in conjunction with the main tray being stored in the image forming apparatus main body.

An image forming apparatus according to the present disclosure includes the sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
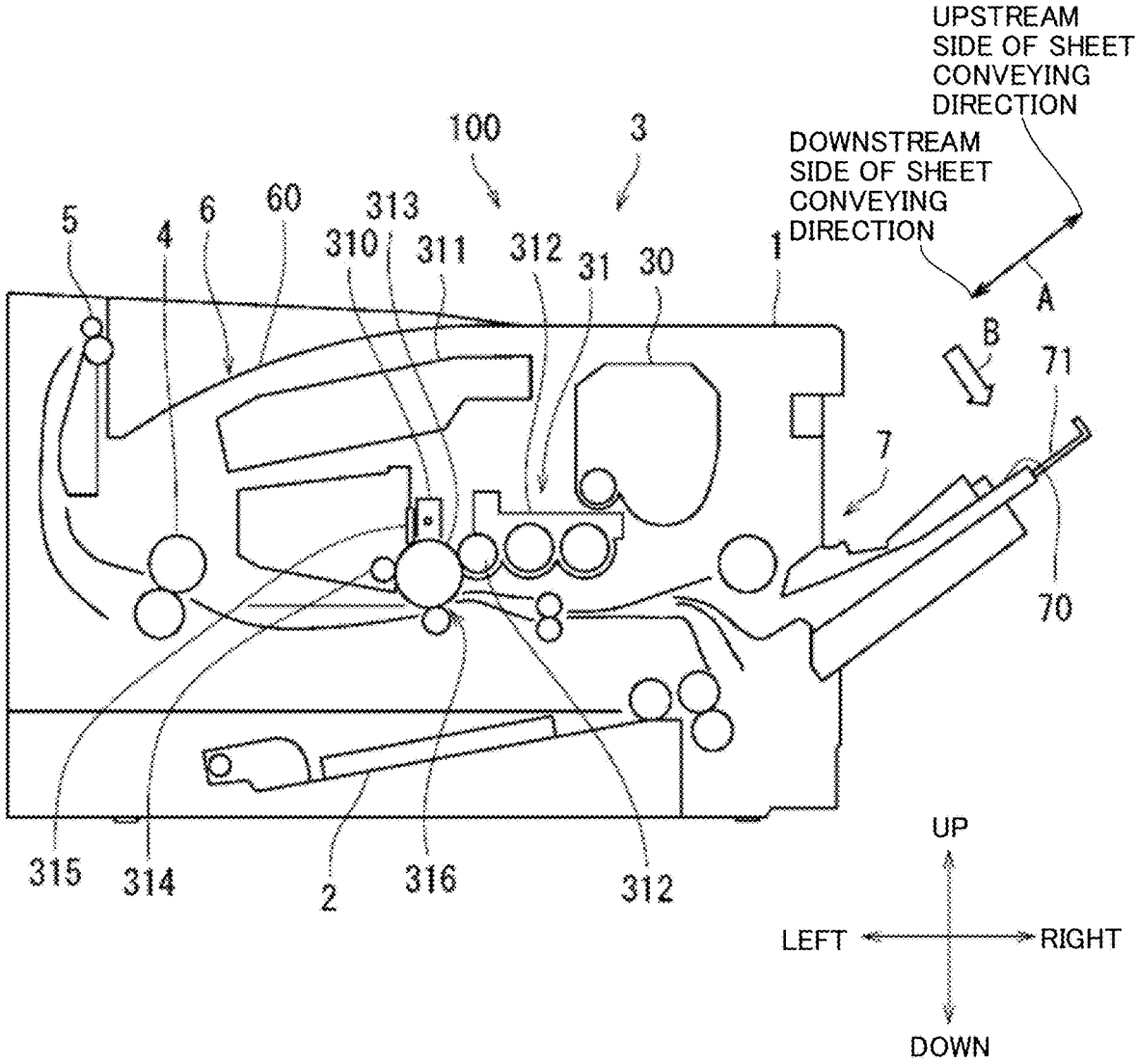
FIG. 1 shows an image forming apparatus including a sheet conveying device according to an embodiment of the present invention.

Hereinafter, embodiments of the present invention will be described with reference to the drawings. It is noted that, in the drawings, the same or corresponding portions are denoted by the same reference numeral, and descriptions thereof will not be repeated.

First Embodiment

An image forming apparatus 100 including a sheet conveying device 7 according to a first embodiment of the present invention will be described with reference to FIG. 1 and FIG. 2. The matters described in the first embodiment can be applied to the second embodiment.

FIG. 1 shows a state of the sheet conveying device 7 according to an embodiment of the present invention, in which a main tray 70 to be described later is exposed from an image forming apparatus main body 1. In FIG. 1, a state in which an auxiliary tray 71 to be described later is pulled out from the main tray 70 is shown.

Figure 2:
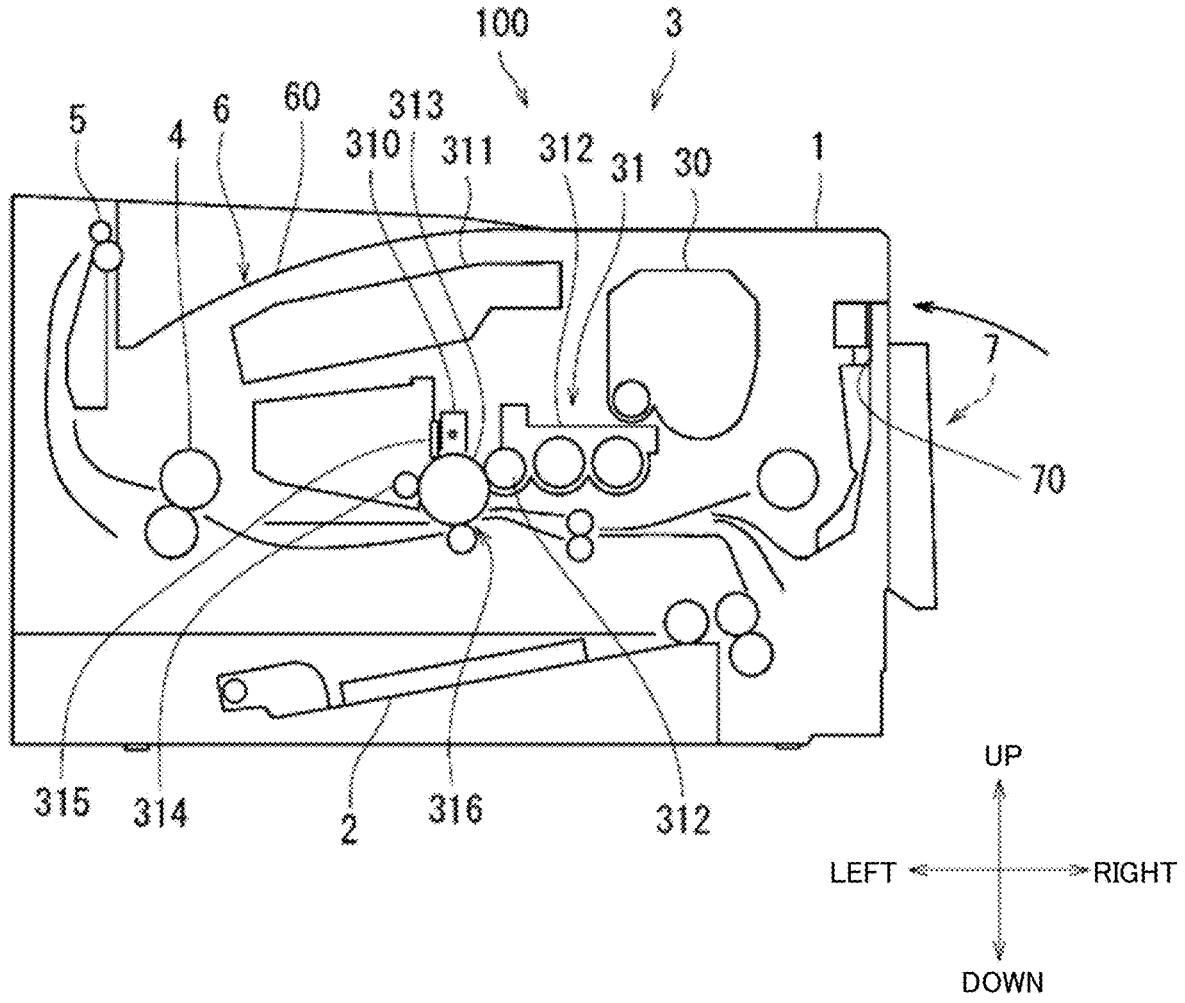
FIG. 2 shows the image forming apparatus including the sheet conveying device according to an embodiment of the present invention.

FIG. 2 shows a state of the sheet conveying device 7 according to an embodiment of the present invention, in which the main tray 70 is stored in the image forming apparatus main body 1. In FIG. 2, a state in which the auxiliary tray 71 is stored in the main tray 70 is shown.

As shown in FIG. 1, the image forming apparatus 100 forms an image on a sheet.

The image forming apparatus 100 includes an image forming apparatus main body 1, a sheet feeding device 2, an image forming function portion 3, a fixing portion 4, a sheet discharge portion 5, a sheet discharge tray 6, and a sheet conveying device 7.

The image forming apparatus main body 1 houses each functional portion (the sheet feeding device 2, the image forming function portion 3, the fixing portion 4, the sheet discharge portion 5, the sheet discharge tray 6, or the sheet conveying device 7) outside or inside the housing. The housing is a case of the image forming apparatus main body 1.

The sheet feeding device 2 can feed a plurality of types of sheets to the image forming function portion 3.

The sheet feeding device 2 includes, for example, a feeding tray, a feeding roller, a conveying path, and a conveying roller.

The feeding tray stores sheets. The feeding roller picks up a sheet and supplies it to the conveying path. The conveying path is formed of, for example, a sheet metal, and the sheet supplied by the feeding roller is conveyed through the conveying path. The conveying roller is, for example, provided at a plurality of positions at intervals on the conveying path, and the conveying rollers convey the sheet supplied to the conveying path by the feeding roller toward the image forming function portion 3.

The image forming function portion 3 forms a toner image on the sheet.

When the image forming apparatus 100 is of an electrophotographic type, the image forming function portion 3 includes a toner supply unit 30 and an image forming portion 31.

The toner supply unit 30 includes, for example, a toner bottle. The toner bottle may be a toner cartridge consisting of a container and a mechanism for supplying toner.

For example, the toner bottle, the toner cartridge, or a containing frame may be disposed for each of Y (yellow), M (magenta), C (cyan), and K (black).

The image forming portion 31 includes a charging device 310, an exposure device 311, a developing device 312, a photoconductor 313, a cleaning device 314, a static eliminator 315, and a transfer device 316.

The charging device 310 charges a photoconductive layer of the photoconductor 313 to a predetermined potential. The charging device 310 is, for example, a corona discharger.

The exposure device 311 irradiates the photoconductive layer of the photoconductor 313 with a laser beam to expose the photoconductive layer. The exposure device 311 exposes the photoconductive layer of the photoconductor 313 based on image data acquired from a control device (not shown). As a result, an electrostatic latent image is formed on the photoconductor 313. The exposure device 311 is, for example, a light emitting diode (LED).

The developing device 312 develops the electrostatic latent image on the photoconductor 313 with toner based on the image data.

The photoconductor 313 is, for example, a photoconductor drum. The photoconductor drum has a photoconductive layer on its outer peripheral surface. The photoconductor drum is, for example, a selenium drum or an organic photoconductor (OPC).

The transfer device 316 transfers the toner image on the photoconductor 313 to a sheet or an intermediate transfer member.

In the case of a direct transfer method, the transfer device 316 directly transfers the toner image from the photoconductor 313 carrying the toner image to the sheet.

In the case of an indirect transfer method, the transfer device 316 primarily transfers the toner image to an intermediate transfer member (not shown), and then secondarily transfers the toner image on the intermediate transfer member to a sheet being conveyed through the conveying path. The transfer device 316 may include a transfer roller that urges the sheet or the intermediate transfer member to the photoconductor 313.

The cleaning device 314 removes residual toner remaining on the photoconductor 313 after the transfer.

The static eliminator 315 eliminates static from the photoconductive surface of the photoconductor 313.

Next, when the image forming apparatus 100 is of an electrophotographic type, the fixing portion 4 heats and pressurizes the toner image developed on the sheet, thereby fixing the toner image on the sheet. The fixing portion 4 includes, for example, a fixing roller, a heater, and a press roller.

The fixing roller is a hollow cylindrical roller. The fixing roller is pressed against the press roller. The press roller and the fixing roller form a nip portion.

The press roller is rotationally driven by a drive portion (not shown), and forms a nip portion together with the fixing roller, thereby rotating the fixing roller.

The heater is supplied with power from a power supply (not shown) to heat the fixing roller. The heater is disposed close to the inner peripheral surface of the fixing roller. The sheet conveyed to the fixing portion 4 is heated by the heater by passing through the nip portion, and the toner image is fixed.

The sheet discharge portion 5 discharges the sheet on which an image has been formed by the image forming portion 31 to the outside of the image forming apparatus main body 1. The sheet discharge portion 5 includes a sheet discharge roller.

The sheet discharge roller discharges the sheet conveyed by the conveying device from the fixing portion 4 to the sheet discharge tray 6. The sheet discharge tray 6 stores the discharged sheet.

The sheet conveying device 7 is used, for example, for manual sheet supply by the user. For example, the manual sheet supply requires, for example, a function that can suitably supply sheets of various sizes, from postcard size to A3 size.

Figure 3:
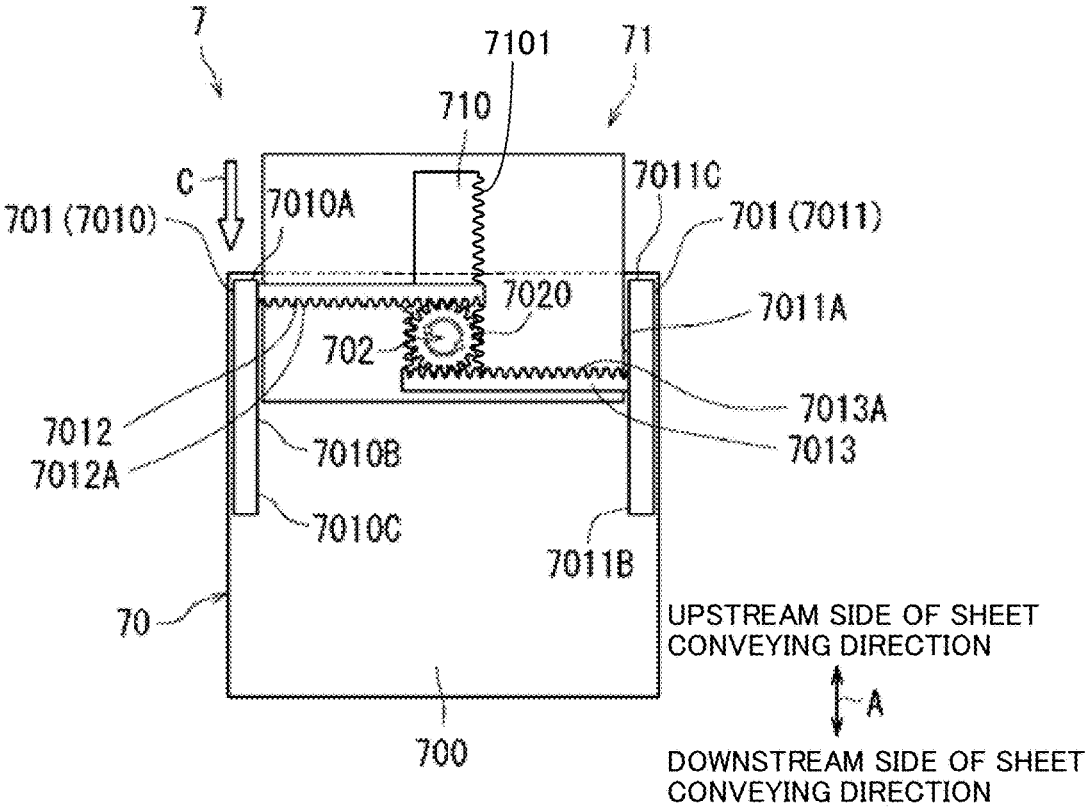
FIG. 3 and FIG. 4 show an operation mode of a width alignment cursor on the main tray of the image forming apparatus according to a first embodiment.
Figure 4:
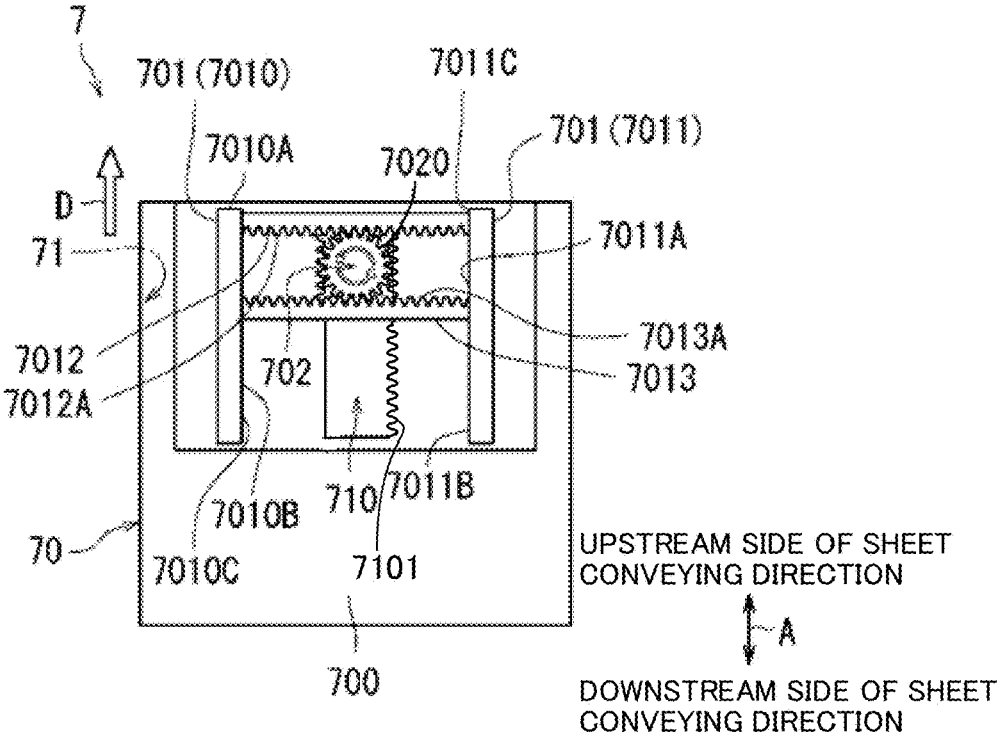

Next, with reference to FIG. 3 and FIG. 4 in addition to FIG. 1 and FIG. 2, the outline of the configuration of the sheet conveying device 7 according to the present embodiment will be described. FIG. 3 and FIG. 4 show an operation mode of a width alignment cursor 701 in the main tray 70, which will be described later, of the sheet conveying device 7.

FIG. 3 is a plan view of the sheet conveying device 7 in a state of being exposed from the housing of the image forming apparatus main body 1 shown in FIG. 1, viewed in the direction of the white arrow B.

FIG. 4 is a plan view of the main tray 70 and the auxiliary tray 71, which will be described later, viewed from inside the image forming apparatus main body 1 in the direction of the arrow to the right when the auxiliary tray 71 is stored in the main tray 70 of the sheet conveying device 7 by its own weight and the main tray 70 is further stored in the housing of the image forming apparatus main body 1 as shown in FIG. 2.

FIG. 4 may be a plan view of the sheet conveying device 7 in which the auxiliary tray 71 is stored in the main tray 70 manually by the user in a state where the main tray 70 and the auxiliary tray 71 of the sheet conveying device 7 are exposed from the housing of the image forming apparatus main body 1 as shown in FIG. 1, viewed in the direction of the white arrow B.

As shown in FIG. 3 and FIG. 4, the sheet conveying device 7 includes the main tray 70 and the auxiliary tray 71.

The main tray 70 is used, for example, to form an image on small to medium-sized sheets, about postcard size to A4 size.

The main tray 70 includes a sheet placing portion 700, a width alignment cursor 701, and a pinion gear 702.

A sheet on which an image is to be formed in the image forming apparatus main body 1 is placed on the sheet placing portion 700 manually by the user.

The width alignment cursor 701 aligns the widths of a plurality of sheets manually placed by the user.

The width alignment cursor 701 includes a first width alignment cursor 7010, a second width alignment cursor 7011, a first shaft 7012, and a second shaft 7013.

The first width alignment cursor 7010 and the second width alignment cursor 7011 are disposed parallel to a sheet conveying direction A on the main tray 70.

The first width alignment cursor 7010 and the second width alignment cursor 7011 are interlocked with each other in a sheet width direction (the direction perpendicular to the sheet conveying direction A) for the structural reason to be described later.

That is, when the first width alignment cursor 7010 shown in FIG. 3 moves from the left side to the right side in the drawing as shown in FIG. 4, the second width alignment cursor 7011 shown in FIG. 3 also moves from the right side to the left side in the drawing as shown in FIG. 4 in conjunction with the first width alignment cursor 7010.

Similarly, when the first width alignment cursor 7010 shown in FIG. 4 moves from the right side to the left side in the drawing as shown in FIG. 3, the second width alignment cursor 7011 shown in FIG. 4 also moves from the left side to the right side in the drawing as shown in FIG. 3 in conjunction with the first width alignment cursor 7010.

The first width alignment cursor 7010 has a front end portion 7010A (FIG. 4).

The second width alignment cursor 7011 has a middle portion 7011A and a rear end portion 7011B.

The first width alignment cursor 7010 may have a middle portion 7010B and a rear end portion 7010C.

The second width alignment cursor 7011 may have a front end portion 7011C.

The first shaft 7012 has first continuous teeth 7012A.

The second shaft 7013 has second continuous teeth 7013A.

The pinion gear 702 has third continuous teeth 7020.

The pinion gear 702 is supported by a rotation shaft fixed to the main tray 70.

The pinion gear 702 move the first width alignment cursor 7010 and the second width alignment cursor 7011 while rotating with the third continuous teeth 7020 meshing with the first shaft 7012 and the second shaft 7013.

Next, the auxiliary tray 71 can be stored in the main tray 70. The auxiliary tray 71 can be pulled out from the main tray 70.

The auxiliary tray 71 is pulled out from the main tray 70 for use as shown in FIG. 3, for example, when an image is formed on a large sheet of B4 size or larger.

The auxiliary tray 71 has a movable frame 710.

The movable frame 710 is formed in the approximate center in the sheet width direction of the auxiliary tray 71 so as to extend longitudinally in the sheet conveying direction A.

The movable frame 710 has fourth continuous teeth 7101.

As shown in FIG. 3, the fourth continuous teeth 7101 may be disposed on the left side in the drawing.

The fourth continuous teeth 7101 may be disposed on the right side in the drawing of FIG. 3.

The movable frame 710 is formed, for example, in the approximate center in the sheet width direction of the auxiliary tray 71 so as to extend longitudinally in the sheet conveying direction A.

The configuration and operation of the sheet conveying device 7 according to the present embodiment will be described in more detail below based on the configuration of the sheet conveying device 7 described above.

As shown in FIG. 1 and FIG. 2, the sheet conveying device 7 (the main tray 70 and the auxiliary tray 71) can be exposed from and stored in the image forming apparatus main body 1 by being pivotably supported by the image forming apparatus main body 1.

As shown in FIG. 1, FIG. 3, and FIG. 4, the sheet conveying device 7 includes the main tray 70.

As shown in FIG. 1, in a state where the main tray 70 is exposed from the image forming apparatus main body 1, a sheet (not shown) can be placed on the main tray 70, and the sheet can be supplied from the main tray 70 into the image forming apparatus main body 1.

As shown in FIG. 1, the sheet placed on the sheet conveying device 7 is conveyed from the main tray 70 or the auxiliary tray 71 to the image forming function portion 3 from upstream of the sheet conveying direction A to downstream of the sheet conveying direction A.

As shown in FIG. 3 and FIG. 4, the main tray 70 includes the sheet placing portion 700 and the width alignment cursor 701.

The width alignment cursor 701 is disposed on the sheet placing portion 700 and aligns the width of the sheet.

The width alignment cursor 701 moves in the sheet width direction in conjunction with the main tray 70 being stored in the image forming apparatus main body 1 in the direction of the white arrow C.

Further, the sheet width direction can also be defined as the main scanning direction.

As shown in FIG. 1 and FIG. 2, the main scanning direction is a direction in which the exposure device 311 performs laser scanning on the photoconductor 313.

When the sub-scanning direction is defined as a direction in which the sheet is conveyed to the image forming portion 31, the main scanning direction can be defined as a direction perpendicular to the sub-scanning direction on the plane of the sheet.

According to the present embodiment, the width alignment cursor 701 moves in the sheet width direction in conjunction with the main tray 70 being stored in the image forming apparatus main body 1. Therefore, when the main tray 70 is stored in the image forming apparatus main body 1, the width alignment cursor 701 can be prevented from colliding with other functional portions of the image forming apparatus main body 1.

Next, the sheet conveying device 7 according to the present embodiment will be described in detail with continued reference to FIG. 1 to FIG. 4.

As shown in FIG. 1, FIG. 3, and FIG. 4, the sheet conveying device 7 includes the auxiliary tray 71.

The auxiliary tray 71 can be stored in the main tray 70 in the direction of the white arrow C and can be pulled out from the main tray 70.

The width alignment cursor 701 includes the first width alignment cursor 7010, the second width alignment cursor 7011, the first shaft 7012, and the second shaft 7013.

The first width alignment cursor 7010 is formed to extend along the sheet conveying direction A. The first width alignment cursor 7010 regulates the sheet width direction.

The second width alignment cursor 7011 is disposed to face the first width alignment cursor 7010 in the sheet width direction. The second width alignment cursor 7011 is formed to extend along the sheet conveying direction A. The second width alignment cursor 7011 regulates the sheet width direction.

The first shaft 7012 is formed such that one end thereof is connected to the first width alignment cursor 7010 and the other end thereof extends toward the second width alignment cursor 7011. The first shaft 7012 has the first continuous teeth 7012A.

The second shaft 7013 is formed such that one end thereof is connected to the second width alignment cursor 7011 and the other end thereof extends toward the first width alignment cursor 7010. The second shaft 7013 has the second continuous teeth 7013A.

The main tray 70 has the pinion gear 702. The pinion gear 702 has the third continuous teeth 7020 which mesh with the first shaft 7012 and the second shaft 7013.

The pinion gear 702 is rotatably supported by the main tray 70.

The movable frame 710 is formed on the auxiliary tray 71. The movable frame 710 is formed to extend in the sheet conveying direction A. The fourth continuous teeth 7101 are formed in the movable frame 710. The fourth continuous teeth 7101 mesh with the third continuous teeth 7020 of the pinion gear 702.

As the main tray 70 is stored in the image forming apparatus main body 1 in the direction of the white arrow C, the auxiliary tray 71 is stored in the main tray 70 by its own weight.

As the auxiliary tray 71 is stored in the main tray 70 in the direction of the white arrow C, the pinion gear 702 rotates with the third continuous teeth 7020 meshing with the fourth continuous teeth 7101 of the movable frame 710.

As the auxiliary tray 71 is stored in the main tray 70 in the direction of the white arrow C, the first shaft 7012 and the second shaft 7013 move in the sheet width direction while the first continuous teeth 7012A and the second continuous teeth 7013A mesh with the third continuous teeth 7020 of the pinion gear 702.

As the auxiliary tray 71 is stored in the main tray 70 in the direction of the white arrow C, the first width alignment cursor 7010 and the second width alignment cursor 7011 move closer to each other.

That is, a case where the main tray 70 and the auxiliary tray 71 in a state of being exposed from the image forming apparatus main body 1 as shown in FIG. 1 (FIG. 3) are stored in the image forming apparatus main body 1 as shown in FIG. 2 (FIG. 4) will be described.

In the state of being exposed from the image forming apparatus main body 1 as shown in FIG. 1, the auxiliary tray 71 may be pulled out from the main tray 70 manually by the user as shown in FIG. 3.

As shown in FIG. 3, when the auxiliary tray 71 is pulled out from the main tray 70, the pinion gear 702 is located most downstream of the movable frame 710 in the sheet conveying direction A.

At this time, the third continuous teeth 7020 of the pinion gear 702 are stationary while meshing with the rightmost first continuous teeth 7012A of the first shaft 7012 in the drawing and meshing with the leftmost second continuous teeth 7013A of the second shaft 7013 in the drawing.

In addition, at this time, the first width alignment cursor 7010 has moved to the leftmost side of the main tray 70 in the drawing and is stationary. Similarly, the second width alignment cursor 7011 has moved to the rightmost side of the main tray 70 and is stationary. That is, the first width alignment cursor 7010 and the second width alignment cursor 7011 are farthest from each other.

Next, as shown in FIG. 2, the main tray 70 and the auxiliary tray 71 are stored in the image forming apparatus main body 1 in the direction of the white arrow C.

The auxiliary tray 71 shown in FIG. 3 moves downstream of the sheet conveying direction A by its own weight as shown in FIG. 4 even if the user does not operate the auxiliary tray 71.

When the auxiliary tray 71 moves by its own weight, the third continuous teeth 7020 of the pinion gear 702 mesh with the fourth continuous teeth 7101 of the movable frame 710, so that the pinion gear 702 rotates clockwise in the drawing.

The third continuous teeth 7020 of the pinion gear 702 also mesh with the first continuous teeth 7012A of the first shaft 7012 and the second continuous teeth 7013A of the second shaft 7013.

Therefore, as shown in FIG. 3 and FIG. 4, when the pinion gear 702 rotates clockwise in the drawing, the first shaft 7012 moves from the left side in the drawing to the right side in the drawing, and the second shaft 7013 also moves from the right side in the drawing to the left side in the drawing.

As the first shaft 7012 moves from the left side in the drawing to the right side in the drawing, the first width alignment cursor 7010 also moves from the left side in the drawing to the right side in the drawing, and as the second shaft 7013 moves from the right side in the drawing to the left side in the drawing, the second width alignment cursor 7011 also moves from the right side in the drawing to the left side in the drawing. When the rotation of the pinion gear 702 is completed, the first width alignment cursor 7010 and the second width alignment cursor 7011 are closest to each other.

According to the present embodiment, the auxiliary tray 71 is stored in the main tray 70 by its own weight in conjunction with the operation of storing the main tray 70 in the image forming apparatus main body 1, and the first width alignment cursor 7010 and the second width alignment cursor 7011 move closer to each other. Therefore, when the main tray 70 is stored in the image forming apparatus main body 1, the width alignment cursor 701 can be prevented from colliding with other functional portions of the image forming apparatus main body 1, thereby enhancing the user operability.

Next, when the main tray 70 is exposed from the image forming apparatus main body 1, the auxiliary tray 71 can be pulled out from the main tray 70.

That is, the user moves the main tray 70 and the auxiliary tray 71 from a state in which they are stored in the image forming apparatus main body 1 as shown in FIG. 2 to a state in which they are exposed from the image forming apparatus main body 1 as shown in FIG. 1. The auxiliary tray 71 can be pulled out from the main tray 70 manually by the user.

When the auxiliary tray 71 is pulled out from the main tray 70, the pinion gear 702 rotates with the third continuous teeth 7020 meshing with the fourth continuous teeth 7101 of the movable frame 710.

When the auxiliary tray 71 is pulled out from the main tray 70, the first shaft 7012 and the second shaft 7013 move in the sheet width direction while the first continuous teeth 7012A and the second continuous teeth 7013A mesh with the third continuous teeth 7020 of the pinion gear 702 as the auxiliary tray 71 is pulled out from the main tray 70.

When the auxiliary tray 71 is pulled out from the main tray 70, the first width alignment cursor 7010 and the second width alignment cursor 7011 move away from each other.

According to the present embodiment, for example, when a large-sized sheet such as a B4 size sheet or an A3 size sheet is subjected to an image forming process and the distance between the first width alignment cursor 7010 and the second width alignment cursor 7011 is desired to be increased, the distance between the first width alignment cursor 7010 and the second width alignment cursor 7011 increases in conjunction with the user's operation of pulling out the auxiliary tray 71 from the main tray 70. Therefore, the user operability is further enhanced.

That is, as shown in FIG. 2, when the main tray 70 and the auxiliary tray 71 are stored in the image forming apparatus main body 1, the first width alignment cursor 7010 and the second width alignment cursor 7011 are closest to each other.

Next, as shown in FIG. 1, the main tray 70 and the auxiliary tray 71 are moved so as to be exposed from the image forming apparatus main body 1.

Thereafter, the auxiliary tray 71 is pulled out from the main tray 70 manually by the user.

At this time, as shown in FIG. 4 to FIG. 3, the pinion gear 702 rotates counterclockwise in the drawing. Therefore, the first shaft 7012 moves from the right side in the drawing to the left side in the drawing, and the second shaft 7013 also moves from the left side in the drawing to the right side in the drawing.

As the first shaft 7012 moves, the first width alignment cursor 7010 also moves from the right side in the drawing to the left side in the drawing, and as the second shaft 7013 moves, the second width alignment cursor 7011 also moves from the left side in the drawing to the right side in the drawing.

The pinion gear 702 is located most downstream of the movable frame 710 in the sheet conveying direction A.

At this time, the third continuous teeth 7020 of the pinion gear 702 are stationary while meshing with the rightmost first continuous teeth 7012A of the first shaft 7012 in the drawing and meshing with the leftmost second continuous teeth 7013A of the second shaft 7013 in the drawing.

At this time, the first width alignment cursor 7010 and the second width alignment cursor 7011 are farthest from each other.

The user can adjust the amount by which the auxiliary tray 71 is pulled out, in accordance with the size of the sheet on which an image is to be formed. The amount of movement of the first width alignment cursor 7010 and the second width alignment cursor 7011 is also defined in accordance with the amount by which the auxiliary tray 71 is pulled out.

Next, as the auxiliary tray 71 is stored in the main tray 70, the pinion gear 702 rotates with the third continuous teeth 7020 meshing with the fourth continuous teeth 7101 of the movable frame 710.

As the auxiliary tray 71 is stored in the main tray 70, the first shaft 7012 and the second shaft 7013 move in the sheet width direction while the first continuous teeth 7012A and the second continuous teeth 7013A mesh with the third continuous teeth 7020 of the pinion gear 702.

As the auxiliary tray 71 is stored in the main tray 70, the first width alignment cursor 7010 and the second width alignment cursor 7011 move closer to each other.

According to the present embodiment, when the user stores the auxiliary tray 71 in the main tray 70, the first width alignment cursor 7010 and the second width alignment cursor 7011 move closer to each other in accordance with that operation. Therefore, when the main tray 70 is stored in the image forming apparatus main body 1, the width alignment cursor 701 can be prevented from colliding with other functional portions of the image forming apparatus main body 1, thereby enhancing the user operability.

As shown in FIG. 4, the first shaft 7012 is disposed upstream of the pinion gear 702 in the sheet conveying direction A. The second shaft 7013 is disposed downstream of the pinion gear 702 in the sheet conveying direction A.

The first width alignment cursor 7010 has the front end portion 7010A on the upstream side in the sheet conveying direction A. The first width alignment cursor 7010 is connected to the first shaft 7012 at the front end portion 7010A.

The second width alignment cursor 7011 has the middle portion 7011A. The second width alignment cursor 7011 is connected to the second shaft 7013 at the middle portion 7011A.

According to the present embodiment, as shown in FIG. 3, even when the distance between the first width alignment cursor 7010 and the second width alignment cursor 7011 is increased, the positions of the first width alignment cursor 7010 and the second width alignment cursor 7011 in the sheet conveying direction A are aligned.

In addition, as shown in FIG. 4, even when the distance between the first width alignment cursor 7010 and the second width alignment cursor 7011 is narrowed, the positions of the first width alignment cursor 7010 and the second width alignment cursor 7011 in the sheet conveying direction A are aligned. Therefore, it is possible to suppress the disorder of the width alignment of the sheet placed on the main tray 70 or the auxiliary tray 71.

The first shaft 7012 may be disposed downstream of the pinion gear 702 in the sheet conveying direction A.

The second shaft 7013 may be disposed upstream of the pinion gear 702 in the sheet conveying direction A.

The first width alignment cursor 7010 may have a middle portion 7010B in the sheet conveying direction A. The first width alignment cursor 7010 may be connected to the first shaft 7012 at the middle portion 7010B.

The second width alignment cursor 7011 may have a front end portion 7011C in the sheet conveying direction A. The second width alignment cursor 7011 may be connected to the second shaft 7013 at the front end portion 7011C.

The first shaft 7012 may be disposed upstream of the pinion gear 702 in the sheet conveying direction A. The second shaft 7013 may be disposed downstream of the pinion gear 702 in the sheet conveying direction A.

The first width alignment cursor 7010 may have a middle portion 7010B in the sheet conveying direction A. The first width alignment cursor 7010 may be connected to the first shaft 7012 at the middle portion 7010B.

The second width alignment cursor 7011 may have a rear end portion 7011B on the downstream side in the sheet conveying direction A. The second width alignment cursor 7011 may be connected to the second shaft 7013 at the rear end portion 7011B.

The first shaft 7012 may be disposed downstream of the pinion gear 702 in the sheet conveying direction A.

The second shaft 7013 may be disposed upstream of the pinion gear 702 in the sheet conveying direction A.

The first width alignment cursor 7010 may have a rear end portion 7010C on the downstream side in the sheet conveying direction A. The first width alignment cursor 7010 may be connected to the first shaft 7012 at the rear end portion 7010C.

The second width alignment cursor 7011 may have a middle portion 7011A in the sheet conveying direction A. The second width alignment cursor 7011 may be connected to the second shaft 7013 at the middle portion 7011A.

Second Embodiment

Figure 5:
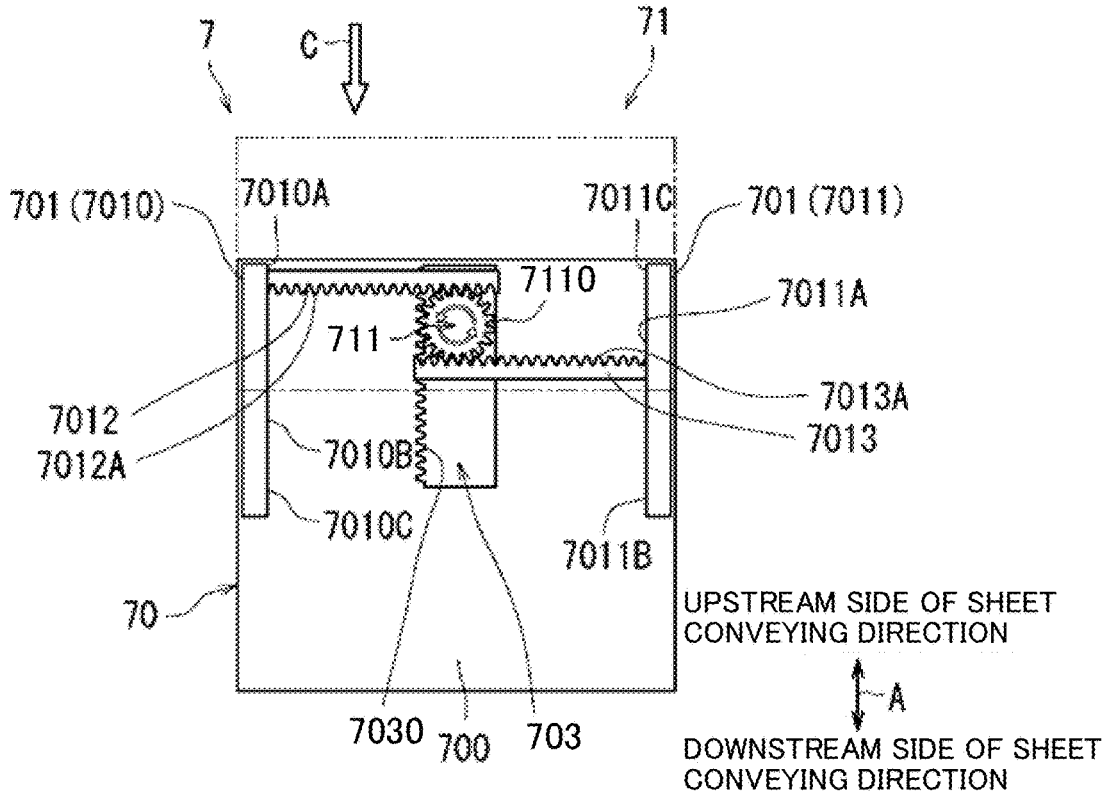
FIG. 5 and FIG. 6 show another operation mode of the width alignment cursor on the main tray of the image forming apparatus according to a second embodiment.
Figure 6:
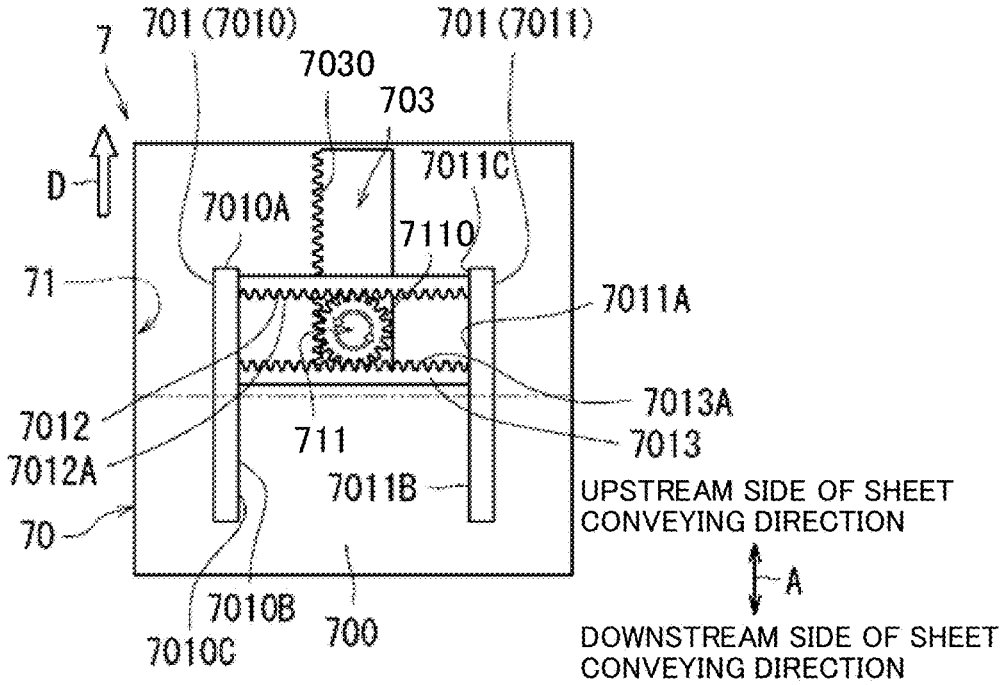

Next, a sheet conveying device 7 according to a second embodiment will be described in detail with reference to FIG. 5 and FIG. 6 in addition to FIG. 1 and FIG. 2. FIG. 5 and FIG. 6 are views showing an operation mode of a width alignment cursor 701 on a main tray 70, which will be described later, of the sheet conveying device 7 according to the second embodiment. The matters described in the second embodiment can be applied to the first embodiment.

Descriptions that overlap with those described in the first embodiment will be omitted.

FIG. 5 is a plan view of the sheet conveying device 7 in a state of being exposed from the housing of the image forming apparatus main body 1 shown in FIG. 1, viewed in the direction of the white arrow B.

FIG. 6 is a plan view of the main tray 70 and the auxiliary tray 71, which will be described later, viewed from inside the image forming apparatus main body 1 in the direction of the arrow to the right when the auxiliary tray 71 is stored in the main tray 70 of the sheet conveying device 7 in the direction of the white arrow C by its own weight and the main tray 70 is further stored in the housing of the image forming apparatus main body 1 as shown in FIG. 2.

FIG. 6 may be a plan view of the sheet conveying device 7 in which the auxiliary tray 71 is stored in the main tray 70 in the direction of the white arrow C manually by the user in a state where the main tray 70 and the auxiliary tray 71 of the sheet conveying device 7 are exposed from the housing of the image forming apparatus main body 1 as shown in FIG. 1, viewed in the direction of the white arrow B.

As shown in FIG. 5 and FIG. 6, the sheet conveying device 7 includes the main tray 70 and the auxiliary tray 71.

The main tray 70 is used, for example, to form an image on small to medium-sized sheets, about postcard size to A4 size.

The main tray 70 includes a sheet placing portion 700, a width alignment cursor 701, and a movable frame 703.

A sheet on which an image is to be formed in the image forming apparatus main body 1 is placed on the sheet placing portion 700 manually by the user.

The width alignment cursor 701 aligns the widths of a plurality of sheets manually placed by the user.

The width alignment cursor 701 includes a first width alignment cursor 7010, a second width alignment cursor 7011, a first shaft 7012, and a second shaft 7013.

The first width alignment cursor 7010 and the second width alignment cursor 7011 are disposed parallel to the sheet conveying direction A on the main tray 70.

The first width alignment cursor 7010 and the second width alignment cursor 7011 are interlocked with each other in the sheet width direction for the structural reason to be described later.

That is, when the first width alignment cursor 7010 shown in FIG. 5 moves from the left side in the drawing to the right side in the drawing as shown in FIG. 6, the second width alignment cursor 7011 shown in FIG. 5 also moves from the right side in the drawing to the left side in the drawing as shown in FIG. 6 in conjunction with the first width alignment cursor 7010.

Similarly, when the first width alignment cursor 7010 shown in FIG. 6 moves from the right side in the drawing to the left side in the drawing as shown in FIG. 5, the second width alignment cursor 7011 shown in FIG. 6 also moves from the left side in the drawing to the right side in the drawing as shown in FIG. 5 in conjunction with the first width alignment cursor 7010.

The first width alignment cursor 7010 has a front end portion 7010A (FIG. 6).

The second width alignment cursor 7011 has a middle portion 7011A and a rear end portion 7011B.

The first shaft 7012 has first continuous teeth 7012A.

The second shaft 7013 has second continuous teeth 7013A.

The movable frame 703 has fourth continuous teeth 7030. The movable frame 703 is formed, for example, in the approximate center in the sheet width direction of the main tray 70 so as to extend longitudinally in the sheet conveying direction A.

The first shaft 7012 and the second shaft 7013 will be described later.

Next, the auxiliary tray 71 is pulled out from the main tray 70 for use as shown in FIG. 5, for example, when an image is formed on a large sheet of B4 size or larger.

The auxiliary tray 71 has the pinion gear 711.

The pinion gear 711 is movably fitted in the movable frame 703.

The pinion gear 711 rotates while meshing with the first shaft 7012 and the second shaft 7013, thereby moving the first width alignment cursor 7010 and the second width alignment cursor 7011.

The pinion gear 711 has third continuous teeth 7110.

The configuration and operation of the sheet conveying device 7 according to the present embodiment will be described in more detail below based on the configuration of the sheet conveying device 7 described above.

As shown in FIG. 1 and FIG. 2, the sheet conveying device 7 (the main tray 70 and the auxiliary tray 71) can be exposed from and stored in the image forming apparatus main body 1 by being pivotably supported by the image forming apparatus main body 1.

As shown in FIG. 1, FIG. 5, and FIG. 6, the sheet conveying device 7 includes the main tray 70.

As shown in FIG. 1, in a state where the main tray 70 is exposed from the image forming apparatus main body 1, a sheet (not shown) can be placed on the main tray 70, and the sheet can be supplied from the main tray 70 into the image forming apparatus main body 1.

As shown in FIG. 1, the sheet placed on the sheet conveying device 7 is conveyed from the main tray 70 or the auxiliary tray 71 to the image forming function portion 3 from upstream of the sheet conveying direction A to downstream of the sheet conveying direction A.

As shown in FIG. 5 and FIG. 6, the main tray 70 includes the sheet placing portion 700 and the movable frame 703. The auxiliary tray 71 includes the width alignment cursor 701 and the pinion gear 711.

The width alignment cursor 701 aligns the width of the sheet placed on the sheet placing portion 700.

The width alignment cursor 701 moves in the sheet width direction in conjunction with the main tray 70 being stored in the image forming apparatus main body 1.

Further, the sheet width direction can also be defined as the main scanning direction.

As shown in FIG. 1 and FIG. 2, the main scanning direction is a direction in which the exposure device 311 performs laser scanning on the photoconductor 313.

When the sub-scanning direction is defined as a direction in which the sheet is conveyed to the image forming portion 31, the main scanning direction can be defined as a direction perpendicular to the sub-scanning direction on the plane of the sheet.

According to the present embodiment, the width alignment cursor 701 moves in the sheet width direction in conjunction with the main tray 70 being stored in the image forming apparatus main body 1. Therefore, when the main tray 70 is stored in the image forming apparatus main body 1, the width alignment cursor 701 can be prevented from colliding with other functional portions of the image forming apparatus main body 1.

Next, the sheet conveying device 7 according to the present embodiment will be described in detail with continued reference to FIG. 1 to FIG. 5.

As shown in FIG. 1, FIG. 5, and FIG. 6, the sheet conveying device 7 includes the auxiliary tray 71.

The auxiliary tray 71 can be stored in the main tray 70 and can be pulled out from the main tray 70.

The width alignment cursor 701 includes a first width alignment cursor 7010, a second width alignment cursor 7011, a first shaft 7012, and a second shaft 7013.

The first shaft 7012 has one end connected to the first width alignment cursor 7010 and the other end extending toward the second width alignment cursor 7011, and has first continuous teeth 7012A.

The second shaft 7013 has one end connected to the second width alignment cursor 7011 and the other end extending toward the first width alignment cursor 7010, and has second continuous teeth 7013A.

The auxiliary tray 71 has a pinion gear 711 having third continuous teeth 7101 that mesh with the first shaft 7012 and the second shaft 7013.

A movable frame 703 is formed along the sheet conveying direction on the main tray 70. The pinion gear 711 is movable along the movable frame 703. The movable frame 702 has fourth continuous teeth 7030 that mesh with the third continuous teeth 7110 of the pinion gear 711.

The auxiliary tray 71 is stored in the main tray 70 by its own weight as the main tray 70 is stored in the image forming apparatus main body 1 in the direction of the white arrow C.

As the auxiliary tray 71 is stored in the main tray 70 in the direction of the white arrow C, the pinion gear 711 moves downstream of the sheet conveying direction A while rotating with the third continuous teeth 7110 meshing with the fourth continuous teeth 7030 of the movable frame 703, the first shaft 7012 and the second shaft 7013 move in the sheet width direction with the first continuous teeth 7012A and the second continuous teeth 7013A meshing with the third continuous teeth 7110 of the pinion gear 711, and the first width alignment cursor 7010 and the second width alignment cursor 7011 move closer to each other.

That is, a case where the main tray 70 and the auxiliary tray 71 in a state of being exposed from the image forming apparatus main body 1 as shown in FIG. 1 (FIG. 5) are stored in the image forming apparatus main body 1 as shown in FIG. 2 (FIG. 6) will be described.

In the state of being exposed from the image forming apparatus main body 1 as shown in FIG. 1, the auxiliary tray 71 may be pulled out from the main tray 70 manually by the user as shown in FIG. 5.

As shown in FIG. 5, when the pinion gear 711 is disposed on the auxiliary tray 71, the pinion gear 711 is disposed most upstream of the movable frame 703 in the sheet conveying direction A.

At this time, the third continuous teeth 7110 of the pinion gear 711 are stationary while meshing with the rightmost first continuous teeth 7012A of the first shaft 7012 in the drawing and meshing with the leftmost second continuous teeth 7013A of the second shaft 7013 in the drawing.

In addition, at this time, the first width alignment cursor 7010 has moved to the leftmost side of the main tray 70 in the drawing and is stationary. Similarly, the second width alignment cursor 7011 has moved to the rightmost side of the main tray 70 and is stationary. That is, the first width alignment cursor 7010 and the second width alignment cursor 7011 are farthest from each other.

Next, as shown in FIG. 2, the main tray 70 and the auxiliary tray 71 are stored in the image forming apparatus main body 1 in the direction of the white arrow C.

The pinion gear 711 shown in FIG. 5 moves downstream of the sheet conveying direction of the arrow A by its own weight as shown in FIG. 6 even if the user does not operate the auxiliary tray 71.

When the pinion gear 711 moves by its own weight, the third continuous teeth 7110 of the pinion gear 711 mesh with the fourth continuous teeth 7030 of the movable frame 703. Therefore, the pinion gear 711 moves downstream of the sheet direction while rotating clockwise in the drawing.

The third continuous teeth 7110 of the pinion gear 711 also mesh with the first continuous teeth 7012A of the first shaft 7012 and the second continuous teeth 7013A of the second shaft 7013.

Therefore, as shown in FIG. 5 to FIG. 6, when the pinion gear 711 moves downstream of the sheet conveying direction while rotating clockwise in the drawing, the first shaft 7012 moves from the left side in the drawing to the right side in the drawing, and the second shaft 7013 also moves from the right side in the drawing to the left side in the drawing.

As the first shaft 7012 moves from the left side in the drawing to the right side in the drawing, the first width alignment cursor 7010 moves from the left side in the drawing to the right side in the drawing, and as the second shaft 7013 moves from the right side in the drawing to the left side in the drawing, the second width alignment cursor 7011 moves from the right side in the drawing to the left side in the drawing. At this time, the first width alignment cursor 7010 and the second width alignment cursor 7011 are closest to each other.

According to the present embodiment, the auxiliary tray 71 is stored in the main tray 70 by its own weight in conjunction with the operation of storing the main tray 70 in the image forming apparatus main body 1, and the first width alignment cursor 7010 and the second width alignment cursor 7011 move closer to each other. Therefore, when the main tray 70 is stored in the image forming apparatus main body 1, the width alignment cursor 701 can be prevented from colliding with other functional portions of the image forming apparatus main body 1, thereby enhancing the user operability.

Next, when the main tray 70 is exposed from the image forming apparatus main body 1, the auxiliary tray 71 can be pulled out from the main tray 70.

That is, when the main tray 70 and the auxiliary tray 71 are moved from a state in which the main tray 70 and the auxiliary tray 71 are stored in the image forming apparatus main body 1 as shown in FIG. 2 to a state in which the main tray 70 and the auxiliary tray 71 are exposed from the image forming apparatus main body 1 as shown in FIG. 1, the auxiliary tray 71 can be pulled out from the main tray 70 manually by the user.

When the auxiliary tray 71 is pulled out from the main tray 70, the pinion gear 711 moves upstream of the sheet conveying direction A while rotating with the third continuous teeth 7110 meshing with the fourth continuous teeth 7030 of the movable frame 703, the first shaft 7012 and the second shaft 7013 move in the sheet width direction with the first continuous teeth 7012A and the second continuous teeth 7013A meshing with the third continuous teeth 7110 of the pinion gear 711 as the auxiliary tray 71 is pulled out from the main tray 70, and the first width alignment cursor 7010 and the second width alignment cursor 7011 move away from each other.

That is, as shown in FIG. 2, when the main tray 70 and the auxiliary tray 71 are stored in the image forming apparatus main body 1, the first width alignment cursor 7010 and the second width alignment cursor 7011 are closest to each other.

Next, as shown in FIG. 1, the main tray 70 and the auxiliary tray 71 are moved so as to be exposed from the image forming apparatus main body 1.

Thereafter, the user manually pulls out the auxiliary tray 71 from the main tray 70 in the direction of the white arrow D.

At this time, as shown in FIG. 6 to FIG. 5, the pinion gear 711 moves upstream of the sheet conveying direction while rotating counterclockwise in the drawing. Therefore, the first shaft 7012 moves from the right side in the drawing to the left side in the drawing, and the second shaft 7013 also moves from the left side in the drawing to the right side in the drawing.

As the first shaft 7012 moves, the first width alignment cursor 7010 also moves from the right side in the drawing to the left side in the drawing, and as the second shaft 7013 moves, the second width alignment cursor 7011 also moves from the left side in the drawing to the right side in the drawing.

The pinion gear 711 is disposed most upstream of the movable frame 703 in the sheet conveying direction A.

At this time, the third continuous teeth 7110 of the pinion gear 711 are stationary while meshing with the rightmost first continuous teeth 7012A of the first shaft 7012 in the drawing and meshing with the leftmost second continuous teeth 7013A of the second shaft 7013 in the drawing.

At this time, the first width alignment cursor 7010 and the second width alignment cursor 7011 are farthest from each other.

The user can adjust the amount by which the auxiliary tray 71 is pulled out, in accordance with the size of the sheet on which an image is to be formed. The amount of movement of the first width alignment cursor 7010 and the second width alignment cursor 7011 is also defined in accordance with the amount by which the auxiliary tray 71 is pulled out.

According to the present embodiment, for example, when a large-sized sheet such as a B4 size sheet or an A3 size sheet is subjected to an image forming process and the distance between the first width alignment cursor 7010 and the second width alignment cursor 7011 is desired to be increased, the distance between the first width alignment cursor 7010 and the second width alignment cursor 7011 increases in conjunction with the user's operation of pulling out the auxiliary tray 71 from the main tray 70. Therefore, the user operability is further enhanced.

Next, as the auxiliary tray 71 is stored in the main tray 70, the pinion gear 711 moves downstream of the sheet conveying direction A while rotating with the third continuous teeth 7110 meshing with the fourth continuous teeth 7030 of the movable frame 703, the first shaft 7012 and the second shaft 7013 move in the sheet width direction with the first continuous teeth 7012A and the second continuous teeth 7013A meshing with the third continuous teeth 7110 of the pinion gear 711, and the first width alignment cursor 7010 and the second width alignment cursor 7011 move closer to each other.

According to the present embodiment, when the user stores the auxiliary tray 71 in the main tray 70, the first width alignment cursor 7010 and the second width alignment cursor 7011 move closer to each other in accordance with that operation. Therefore, when the main tray 70 is stored in the image forming apparatus main body 1, the width alignment cursor 701 can be prevented from colliding with other functional portions of the image forming apparatus main body 1, thereby enhancing the user operability.

As shown in FIG. 6, the first shaft 7012 is disposed upstream of the pinion gear 711 in the sheet conveying direction A. The second shaft 7013 is disposed downstream of the pinion gear 711 in the sheet conveying direction A.

The first width alignment cursor 7010 has a front end portion 7010A on the upstream side in the sheet conveying direction A, and is connected to the first shaft 7012 at the front end portion 7010A.

The second width alignment cursor 7011 has a middle portion 7011A and is connected to the second shaft 7013 at the middle portion 7011A.

In addition, although not shown, the second width alignment cursor 7011 may have a rear end portion 7011B downstream of the sheet conveying direction A, and may be connected to the second shaft 7013 at the rear end portion 7011B.

According to the present embodiment, as shown in FIG. 5, even when the distance between the first width alignment cursor 7010 and the second width alignment cursor 7011 is increased, the positions of the first width alignment cursor 7010 and the second width alignment cursor 7011 in the sheet conveying direction A are aligned. In addition, as shown in FIG. 6, even when the distance between the first width alignment cursor 7010 and the second width alignment cursor 7011 is narrowed, the positions of the first width alignment cursor 7010 and the second width alignment cursor 7011 in the sheet conveying direction A are aligned. Therefore, it is possible to suppress the disorder of the width alignment of the sheet placed on the main tray 70 or the auxiliary tray 71.

Embodiments of the present invention have been described above with reference to the drawings. However, the present invention is not limited to the above-described embodiments, and can be implemented in various modes without departing from the gist thereof. In the drawings, the constituent elements are mainly shown schematically for the sake of easy understanding, and the number and the like of each constituent element shown in the drawings differ from the actual ones for the convenience of preparation of the drawings. In addition, the constituent elements shown in the above embodiments are merely examples and are not particularly limited, and various changes can be made within a range that does not substantially depart from the effects of the present invention.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a main tray capable of being exposed from and stored in an image forming apparatus main body by being pivotably supported by the image forming apparatus main body, wherein when the main tray is exposed from the image forming apparatus main body, a sheet can be placed on the main tray and the sheet can be supplied from the main tray into the image forming apparatus main body; and an auxiliary tray capable of being stored in and pulled out from the main tray in a direction opposite to a conveying direction of the sheet, wherein the main tray includes:

a sheet placing portion; and a frame portion extending in the conveying direction, the auxiliary tray includes:

a width alignment cursor configured to align a width of the sheet; and a pinion gear fitted into the frame portion, the width alignment cursor includes:

a first width alignment cursor formed to extend along the conveying direction and configured to regulate a width direction of the sheet;

a second width alignment cursor facing the first width alignment cursor in the width direction, formed to extend along the conveying direction, and configured to regulate the width direction;

a first shaft including first continuous teeth, with one end connected to the first width alignment cursor and another end formed to extend toward the second width alignment cursor; and a second shaft including second continuous teeth, with one end connected to the second width alignment cursor and another end formed to extend toward the first width alignment cursor, the pinion gear includes third continuous teeth configured to mesh with the first continuous teeth and the second continuous teeth, fourth continuous teeth configured to mesh with the third continuous teeth of the pinion gear are formed on the frame portion, when the auxiliary tray is stored in the main tray, the pinion gear rotates to move along the frame portion, and the first width alignment cursor and the second width alignment cursor move toward each other in conjunction with the rotation of the pinion gear, and when the auxiliary tray is pulled out from the main tray, the pinion gear rotates to move along the frame portion, and the first width alignment cursor and the second width alignment cursor move away from each other in conjunction with the rotation of the pinion gear.

2. The sheet conveying device according to claim 1, wherein when the main tray is stored in the image forming apparatus main body, the auxiliary tray is stored in the main tray by its own weight.

3. An image forming apparatus comprising the sheet conveying device according to claim 1.

* * * * *